United States Patent [19]

Balestrini

[11] 3,972,511

[45] Aug. 3, 1976

[54] RODS FOR ERECTING WIRE FENCES

[76] Inventor: Hector Alberto Balestrini, Peru 283, Buenos Aires, Argentina

[22] Filed: May 1, 1974

[21] Appl. No.: 465,932

[30] Foreign Application Priority Data

May 3, 1973 Argentina ..... 247818

[52] U.S. Cl. ..... 256/47

[51] Int. Cl.[2] ..... B27F 21/00

[58] Field of Search ..... 256/47, 48

[56] References Cited

UNITED STATES PATENTS 315,767 4/1885 Goodwin ..... 256/48

3,671,017 6/1972 Sachs ..... 256/47

*Primary Examiner*—Werner H. Schroeder
*Assistant Examiner*—Doris L. Troutman
*Attorney, Agent, or Firm*—Ladas, Parry, Von Gehr, Goldsmith & Deschamps

[57] ABSTRACT

This invention relates to rods used in the erection of wire fences with said rods being made of hardened wire and provided with deformations at spaced intervals to enable the fence to be attached thereto with latching coils at the ends of the rod.

1 Claim, 4 Drawing Figures

FIG. 1
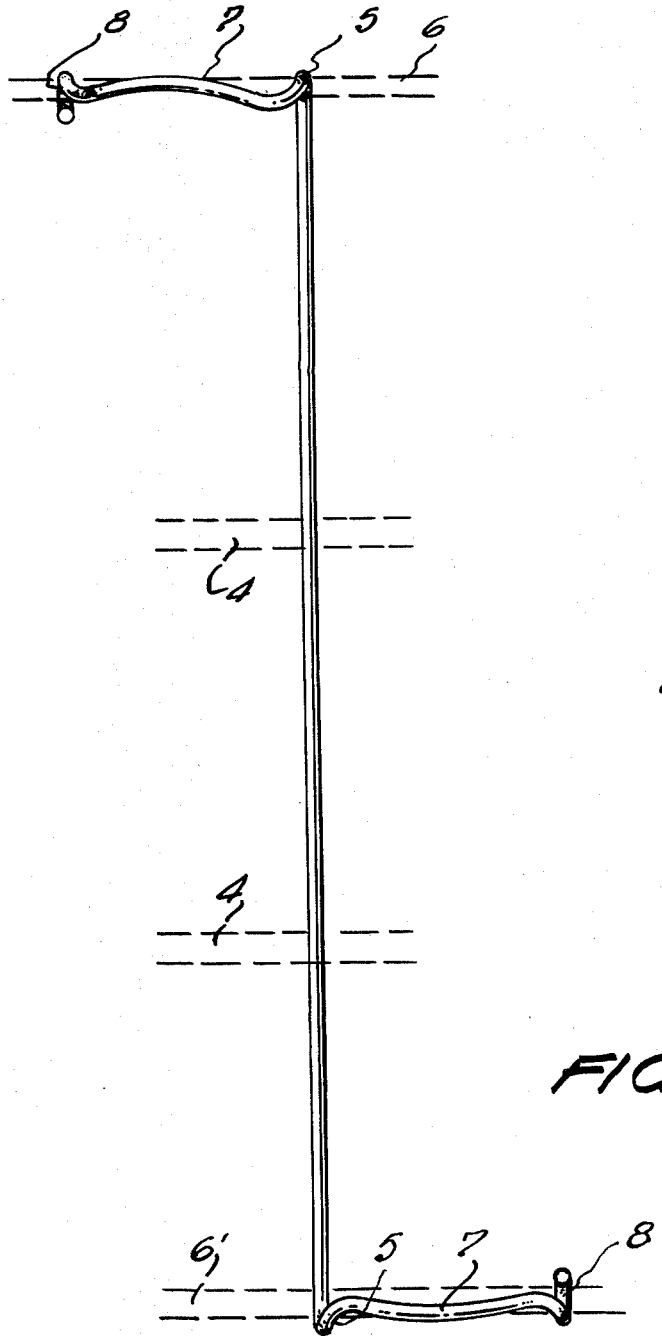
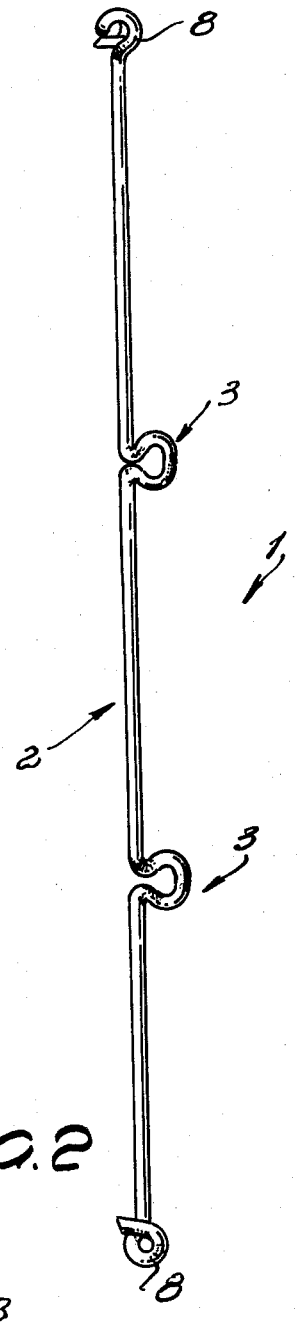
FIG. 2

RODS FOR ERECTING WIRE FENCES

This invention relates to positive improvements in the normal formation of the well known rods that are used in erecting suspended wire fences and which are placed in spaced relation along the same in order to keep the wires of fence equispaced from one another.

At present the known rods exhibit several deficiencies which make their installation as well as the running of the wire fence itself bothersome and slow.

Thus it is known that the conventional rods, apart from being expensive, require for their installation complicated manipulations and skilled labour, and even explicative booklets.

Furthermore, the wire fence must neither be taut nor previously stretched, which would make difficult the installation of the rods and also, quite often, leave the fence in an undesirable condition.

In comparison with the known rods and systems of installation the cost of the device proposed by this invention is substantially less in production as well as in material because instead of being made of iron it may be made of hardened wire, galvanized wire or cadmium-plated wire and in addition is fireproof and corrosion resistant.

Its installation is much easier and quicker because it is applied from the front and with the wire fences already definitively tightened.

These rods are installed or mounted so securely that their removal requires the use of the same tool that was used in installing them.

They may be made for at least three lines of wire, always at a very low production cost.

Their comparatively light weight reduces freight charges and facilitates their manipulation and, which is very important, applies less load to the wires with the consequent advantages.

Figure 3:
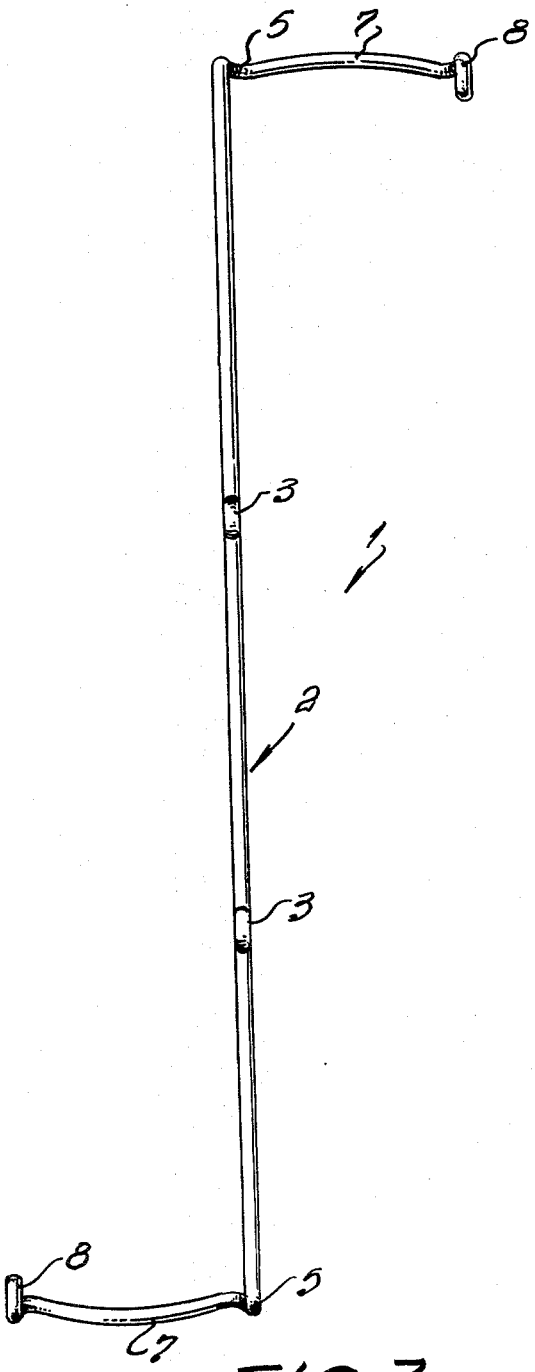
Figure 4:
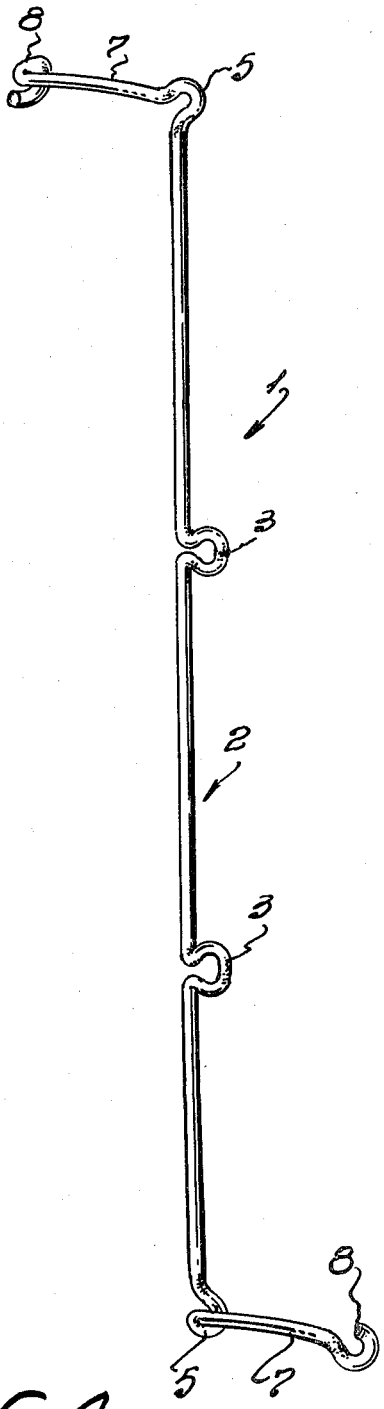

These and other features of the present invention will be explained in the following description with reference to the accompanying drawings by way of illustration only and without limiting the invention. In the said drawings:

FIGS. 1 to 4 show the rod according to this invention as seen from different angles.

As shown in the drawings, the rod 1 consists specifically of a piece of hardened wire having a substantially rectilinear median portion 2.

In the median portion the rod has loops 3 made by simple deformation, the number of which corresponds to the number of inner wire lines 4 to be fastened.

At its opposite ends the rod is provided with coils 5 for latching the upper and the lower wire lines 6—6′ respectively.

The said coils 5 are prolonged in small normal lengths 7 which are slightly bent and end in respective latching coils 8.

The above described particular formation of the rods 1, once the wire fence has been erected and tightend, permits them to be installed and fastened from the front with a small tool simply by turning the top and the bottom of the rod 1.

Once the rod has been fastened to the wires 6—6′, the inner wires 4 are forced to their final restrained position (by leverage and with the same tool) so that the rod 1 will remain definitively fastened not only by its upper and lower ends but also by the loops 3 whose clamping effect will increase as the cattle push against the side of the wire fence.

Undoubtedly, when embodying the invention certain details may be modified as regards structure and shape without departing from the basic principles which are clearly specified in the following claims.

I claim:

1. A rod for erecting a wire fence of the kind wherein several wire lines extend between upright posts, comprising a length of hardened wire having a substantially linear median portion and first and second end portions at upper and lower ends respectively of the median portion, the end portions extending at right angles to the median portion in substantially opposite respective directions so that the median portion and said end portions are substantially coplanar, and the wire being deformed at several locations to form open, substantially C-shaped loops, all of which are open towards the same side of the plane of median portion and the end portions, two of said loops being formed respectively at the junction between the median portion and the first end portion and at that end of the first end portion which is further from the median portion for gripping an upper wire line, the first end portion being deformed at a region intermediate its ends to bear against said upper wire line, two of said loops being formed respectively at the junction between the median portion and the second end portion and at that end of the second end portion which is further from the median portion for gripping a lower wire line, the second end portion being deformed at a region intermediate its ends to bear against said lower wire line, and at least one further loop being formed in the median portion for gripping an intermediate wire line.

* * * * *